United States Patent [19]

Kawanabe et al.

[11] Patent Number: 4,690,121

[45] Date of Patent: Sep. 1, 1987

[54] AIR INTAKE SIDE SECONDARY AIR SUPPLY SYSTEM FOR AN INTERNAL COMBUSTION ENGINE WITH A DUTY RATIO CONTROL OPERATION

[75] Inventors: Tomohiko Kawanabe; Masahiko Asakura; Takanori Shiina, all of Wako; Yukihiro Matsumoto, Fujimi; Minoru Muroya, Wako, all of Japan

[73] Assignee: Honda Giken Kogyo Kabushiki Kaisha, Tokyo, Japan

[21] Appl. No.: 818,630

[22] Filed: Jan. 14, 1986

[30] Foreign Application Priority Data

Feb. 16, 1985 [JP] Japan ..... 60-028758
Sep. 30, 1985 [JP] Japan ..... 60-218505

[51] Int. Cl.[4] ..... F02M 23/06; F02M 23/08; F02M 23/10

[52] U.S. Cl. ..... 123/589; 123/587; 123/588; 123/440

[58] Field of Search ..... 123/440, 459, 585, 587, 123/589, 588

[56] References Cited

U.S. PATENT DOCUMENTS 4,136,651 1/1979 Hattori et al. ..... 123/589
4,478,191 10/1984 Kinoshita et al. ..... 123/589 X
4,478,192 10/1984 Kinoshita et al. ..... 123/589
4,566,419 1/1986 Ninomiya et al. ..... 123/440 X

*Primary Examiner*—Willis R. Wolfe, Jr.
*Attorney, Agent, or Firm*—Pollock, Vande Sande & Priddy

[57] ABSTRACT

An air intake side secondary air supply system for an internal combustion engine having an air intake side secondary air supply passage and an $O_2$ sensor controls a duty ratio of opening and closing of an open/close valve disposed in the air intake side secondary air supply passage in accordance with a detected air-fuel ratio of mixture by means of an output signal of the $O_2$ sensor. The system sets a base valve open period of the open/-close valve every predetermined period and decreases the base valve open period by a first predetermined correction amount when the detected air-fuel ratio is leaner than a target air-fuel ratio, and increases the base valve open period by a second predetermined correction amount when the detected air-fuel ratio is richer than the target air-fuel ratio.

6 Claims, 8 Drawing Figures

AIR INTAKE SIDE SECONDARY AIR SUPPLY SYSTEM FOR AN INTERNAL COMBUSTION ENGINE WITH A DUTY RATIO CONTROL OPERATION

BACKGROUND OF THE INVENTION

1. Field of the Invention

The present invention relates to an air intake side secondary air supply system for an internal combustion engine, and more particularly to a system which performs a duty ratio control of an open/close valve disposed in an air intake side secondary air supply passage.

2. Description of Background Information

Air-fuel ratio feedback control systems for an internal combustion engine are well known as systems in which oxygen concentration in the exhaust gas of the engine is detected by an oxygen concentration sensor (referred to as $O_2$ sensor hereinafter) and the air-fuel ratio of the mixture to be supplied to the engine is feedback controlled in response to an output signal level of the $O_2$ sensor for the purpose of purification of the exhaust gas and improvements of the fuel economy. As an example of the air-fuel ratio feedback control system, an air-intake side secondary air supply system for the feedback control is proposed, for example, in Japanese Patent Publication No. 55-3533, in which an open/close valve is disposed in an air intake side secondary air supply passage leading to the carburetor on the downstream side of the throttle valve, and the open/close valve is on-off controlled in response to the output signal level of the $O_2$ sensor, so as to effect a "duty ratio control" of the supply of the air intake side secondary air. In the system mentioned above, whether the air-fuel ratio of the mixture supplied to the engine is richer or leaner than a target air-fuel ratio is detected in response to the output signal level of the $O_2$ sensor. When the result of the detection is that the air-fuel ratio of the mixture is leaner than the target air-fuel ratio, an opening period of the open/close valve within the period of one duty cycle is decreased by a predetermined decremental amount. On the other hand, when the result of detection is that the air-fuel ratio of the mixture is richer than the target air-fuel ratio, the opening period of the open/-close valve within the period of one duty cycle is increased by a predetermined incremental amount.

However, the $O_2$ sensor used in this type of system generally has a characteristic such that a speed of response under a condition where the air-fuel ratio of the mixture varies from a rich side toward a lean side is slower than a speed of response under a condition where the air-fuel ratio varies from the lean side toward the rich side. Therefore, it has been difficult to control the air-fuel ratio by simply adjusting the valve open time period by a same correction amount without regard to the detected state of the air-fuel ratio of the mixture, i.e., whether the detected air-fuel ratio is lean or rich.

Further, in the air intake side secondary air supply systems, the operation of the system is such that the air-fuel ratio of the mixture to be supplied to the engine is controlled toward a predetermined target air-fuel ratio. Therefore, it is desirable to set the target air-fuel ratio at a value greater (leaner) than a stoichiometric value within a level which does not cause a misfire, and to effect a PI type control of the supply of the air intake side secondary air, which is a combination of a proportional type control and an integral type control.

However, if a correction value of an integration term or a proportional term is determined to be the same in both cases where the air-fuel ratio is controlled toward the lean side and the air-fuel ratio is controlled toward the rich side, it is very likely that the control operation from the lean side to the rich side is delayed due to a time period from a point at which the air-fuel ratio of the mixture is controlled in the air intake system by the supply of the secondary air to a point of time at which a result of control operation is detected as a change in the oxygen concentration in the exhaust gas. Therefore, a problem of the delay of response has to be solved for providing good driveability of the vehicle.

OBJECT AND SUMMARY OF THE INVENTION

An object of the present invention is to provide an air intake side secondary air supply system for an internal combustion engine, in which the air-fuel ratio is precisely controlled toward a target value even if the speed of response of the $O_2$ sensor changes depending on the direction of the change in the air-fuel ratio.

Another object of the present invention is to provide an air intake side secondary air supply system in which the target air-fuel ratio is set to be greater than the stoichiometric air-fuel ratio, and the PI type control of the supply of the air intake side secondary air is effected without a trade off of the driveability.

According to the present invention, the air intake side secondary air supply system detects whether the air-fuel ratio of the mixture to be supplied to the engine is lean or rich with respect to a target air-fuel ratio in terms of an output signal level of the $O_2$ sensor every predetermined time period. If the result of detection is that the air-fuel ratio of the mixture is lean, the valve open time period of the open/close valve within one duty cycle is decreased by a first predetermined correction amount. If, on the other hand, the result of detection is that the air-fuel ratio is rich, the valve open time period of the open/close valve is increased by a second predetermined correction amount which is different from the first predetermined correction amount.

According to another aspect of the invention, the air intake side secondary air supply system is designed to increase the first predetermined correction amount for correcting the valve open time period when the air-fuel ratio of the mixture to be supplied to the engine has changed from the rich side to the lean side with respect to the target air-fuel ratio, and to increase the second predetermined correction amount for correcting the valve open time period to an extent that the second predetermined correction amount is smaller than the first predetermined correction amount when the air-fuel ratio of the mixture has changed from the lean side to the rich side with respect to the target air-fuel ratio.

DETAILED DESCRIPTION OF THE PREFERRED EMBODIMENTS

Referring to the accompanying drawings, the embodiments of the air intake side secondary air supply system according to the present invention will be explained hereinafter.

Figure 1:
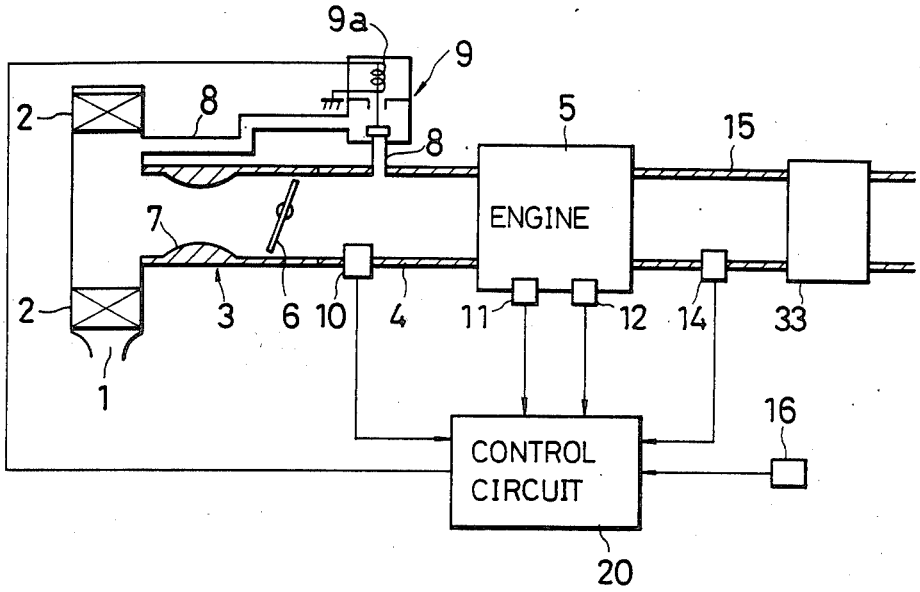
FIG. 1 is a schematic diagram showing a general construction of the system according to the invention.

In FIG. 1 which illustrates a general construction of the air intake side secondary air supply system according to the present invention, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean $O_2$ sensor 14 which is provided in an exhaust manifold 15 of the engine for generating an output signal whose level varies in proportion to an oxygen concentration in the exhaust gas.

Figure 2:
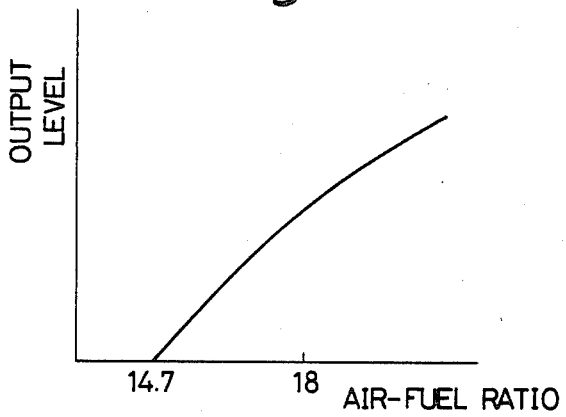
FIG. 2 is a diagram showing a signal output characteristic of the $O_2$ sensor 14 used in the system of FIG. 1.

FIG. 2 shows a signal output characteristic of the $O_2$ sensor 14. As shown, the output signal level of the $O_2$ sensor increases proportionally as the oxygen concentration in the exhaust gas becomes leaner from a stoichiometric air-fuel ratio value (14.7). Further, a catalytic converter 33 for accelerating the reduction of the noxious components in the exhaust gas is provided in the exhaust manifold 15 at a location on the downstream side of the position of the $O_2$ sensor 14. The open/close solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 for producing an output signal whose level is proportional to the speed of the vehicle is electrically connected to the control circuit 20.

Figure 3:
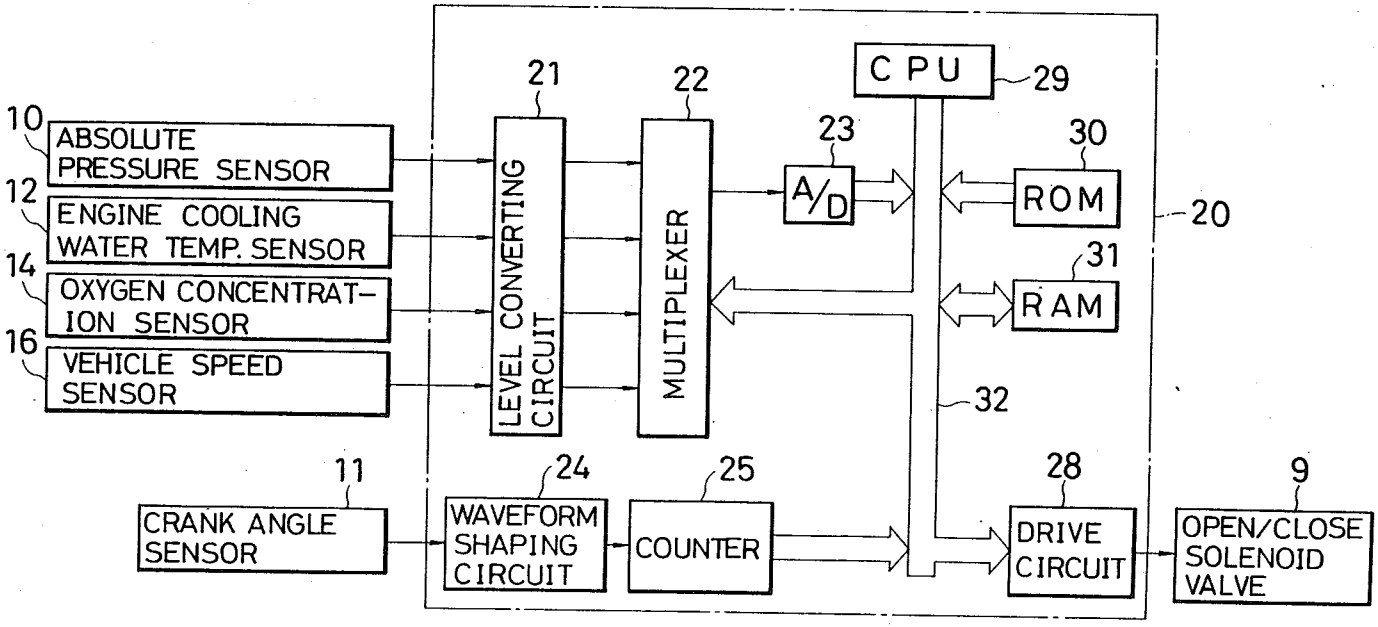
FIG. 3 is a block diagram showing the construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24, which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for opening the open/close solenoid valve 9, a CPU (central processing unit) 29 which performs digital operations according to various programs, a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed are selectively supplied from the A/D converter 23 to the CPU 29 via the input/output bus 32. Also, information indicative of the engine speed from the counter 25 is supplied to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 4:
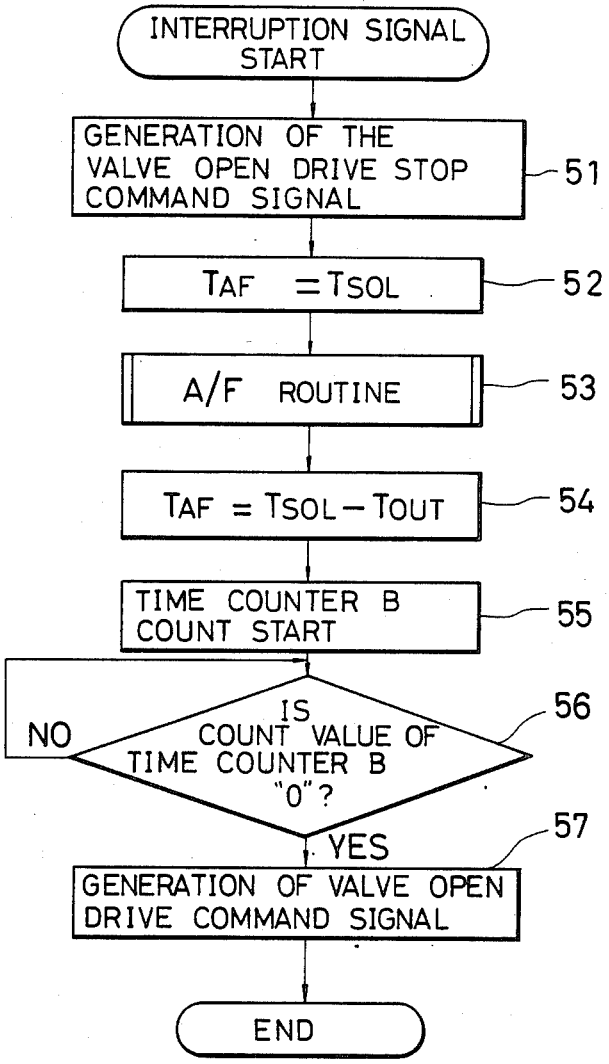
FIGS. 4 and 5 are flowcharts showing steps of operation of a CPU 29 in the control circuit 20.
Figure 5:
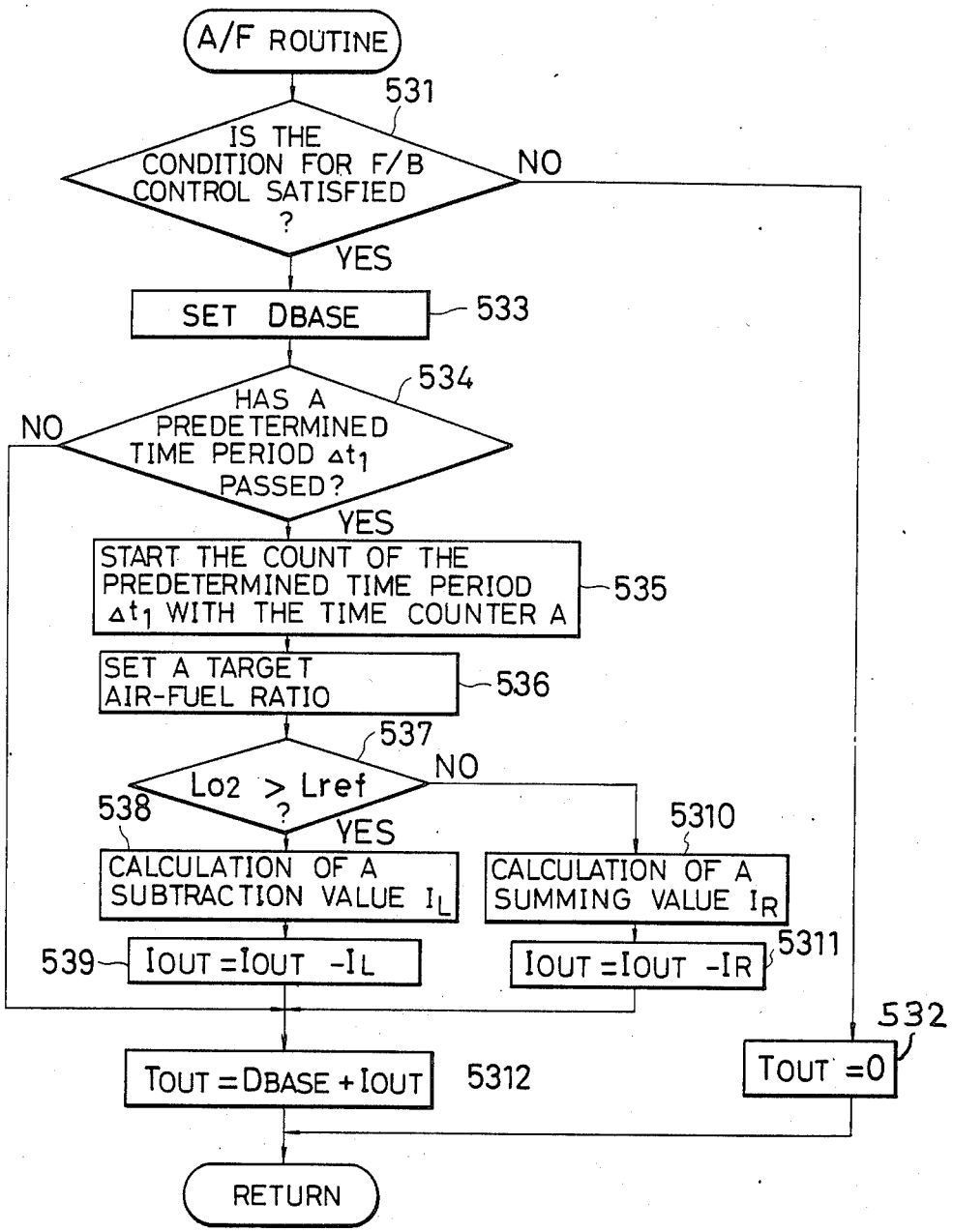

Referring to the flowcharts of FIGS. 4 and 5, the operation of the air intake side secondary air supply system according to the present invention will be explained hereinafter.

At step 51, a valve open drive stop command signal is generated in the CPU 29 and supplied to the drive circuit 28, every time an internal interruption signal is generated in the CPU 29. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at step 52, and an A/F routine for calculating a valve open period $T_{OUT}$ of the open/close solenoid valve 9 which is shown in FIG. 5 is carried out through steps generally indicated at 53.

Figure 6:
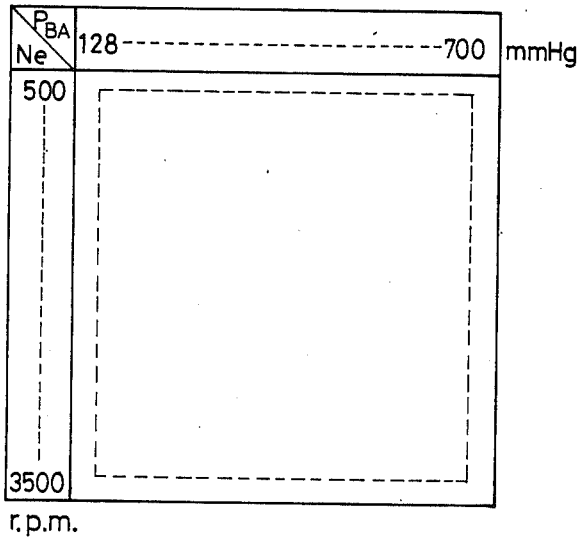
FIG. 6 is a diagram showing a data map which is previously stored in a ROM 30 of the control circuit 20.

In the A/F routine, whether or not the operating state of the vehicle (including operating states of the engine) satisfies a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9 is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 6, and the CPU 29 first reads current values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A, incorporated in the CPU 29 (not shown), has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the $O_2$ sensor as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the intital value by the time counter A, i.e. the execution of the step 535, is performed at the step 534. After the start of the counting of the predetermined time period $\Delta t_1$ by the time counter A in this way, a target air-fuel ratio which is leaner than the stoichiometric air-fuel ratio is set at a step 536. For the setting of the target air-fuel ratio, various values for a reference level Lref corresponding to the target air-fuel ratio which is determined according to the values of the absolute pressure within the intake manifold $P_{BA}$ and the engine speed $N_e$ as in the case of the $D_{BASE}$ data map, are previously stored in the ROM 30 as an A/F data map. Therefore, the CPU 29 searches a reference level Lref corresponding to the current values of the absolute pressure $P_{BA}$ and the engine speed $N_e$ from the A/F data map. Next, from the information of the oxygen concentration, whether or not the output signal level $LO_2$ of the $O_2$ sensor 14 is greater than the reference level Lref determined at the step 536 is detected at a step 537. In other words, whether or not an air-fuel ratio of the mixture to be supplied to the engine 5 is leaner than the target air-fuel ratio is detected at the step 537. If $LO_2 > Lref$, it means that the air-fuel ratio of the mixture is leaner than the target air-fuel ratio, and a subtraction value $I_L$ is calculated at a step 538. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of the operation of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 539. On the other hand, if $LO_2 \leqq Lref$ at the step 537, then the current air-fuel ratio of the mixture is richer than the target air-fuel ratio, and a summing value $I_R$ is calculated at a step 5310. The summing value $I_R$ is calculated by a multiplication of a constant value $K_2(\neq K_1)$, the engine speed $N_e$, and the absolute pressure $P_{BA}(K_2 \cdot N_e \cdot P_{BA})$, and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5311. After the calculation of the correction value $I_{OUT}$ at the step 539 or the step 5311 in this way, the correction value $I_{OUT}$ and the period of base duty ratio $D_{BASE}$ set at the step 533 are added together, and the result is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$, at a step 54. Subsequently, a value corresponding to the valve close period $T_{AF}$ is set in a time counter B incorporated in the CPU 29 (not shown), and a down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 7:
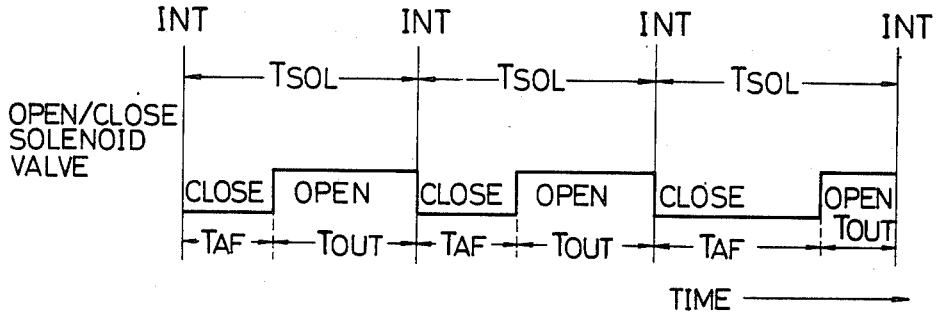
FIG. 7 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 7 to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations.

The air-fuel ratio of the mixture to be supplied to the engine 5 is controlled toward the target air-fuel ratio by the duty ratio control of the supply of the air intake side secondary air in this way.

In the above explained embodiment, a delay of the operation of the system when the amount of the intake air is large, which delay is due to a time required from the supply of the air intake side secondary air to the detection of the oxygen concentration in the exhaust gas, is compensated for because the subtraction value $I_L$ and the summing value $I_R$ are set in accordance with the amount of the intake air in such a manner that the value increases with the amount of the intake air.

Further, in the above explained embodiment, the speed of response of the $O_2$ sensor is higher when the air-fuel ratio is changing toward the rich side than that when the air-fuel ratio is changing toward the lean side. However, it should be noted that the present invention is applicable when the speed of response of the $O_2$ sensor is higher when the air-fuel ratio is changing toward the rich side than when the air-fuel ratio is changing toward the lean side.

Thus, in the air intake side secondary air supply system according to the present invention, the valve open period of the open/close valve within each duty cycle is decreased by a first predetermined amount when the air-fuel ratio of the mixture to be supplied to the engine is detected to be leaner than the target air-fuel ratio by means of the output signal level of the $O_2$ sensor, and increased by the second predetermined amount different from the first predetermined amount when the detected air-fuel ratio is richer than the target air-fuel ratio. Therefore, a difference between two values of the delay time from the supply of the air intake side secondary air to the detection of the oxygen concentration in the exhaust gas which is caused by the difference between the speeds of response of the $O_2$ sensor depending on the direction of the change in the air-fuel ratio is compensated for by the difference between the correction amounts of the supply of the air intake side secondary air per unit time depending on the direction of the change in the air-fuel ratio. In this way, the air-fuel ratio of the mixture to be supplied to the engine is controlled very precisely toward the target air-fuel ratio.

Further, the use of the "lean" $O_2$ sensor is generally disadvantageous as compared with the conventional $O_2$ sensor whose output signal level does not vary proportionally to the oxygen concentration, in that the difference between the speeds of response depending on the direction of the change in the air-fuel ratio tends to affect adversely the accuracy of the air-fuel ratio control because the level of the output signal of the $O_2$ sensor follows the change in the air-fuel ratio. However, with the system according to the present invention, it is possible to avoid the above disadvantage, to realize a very accurate control of the air-fuel ratio.

Figure 8:
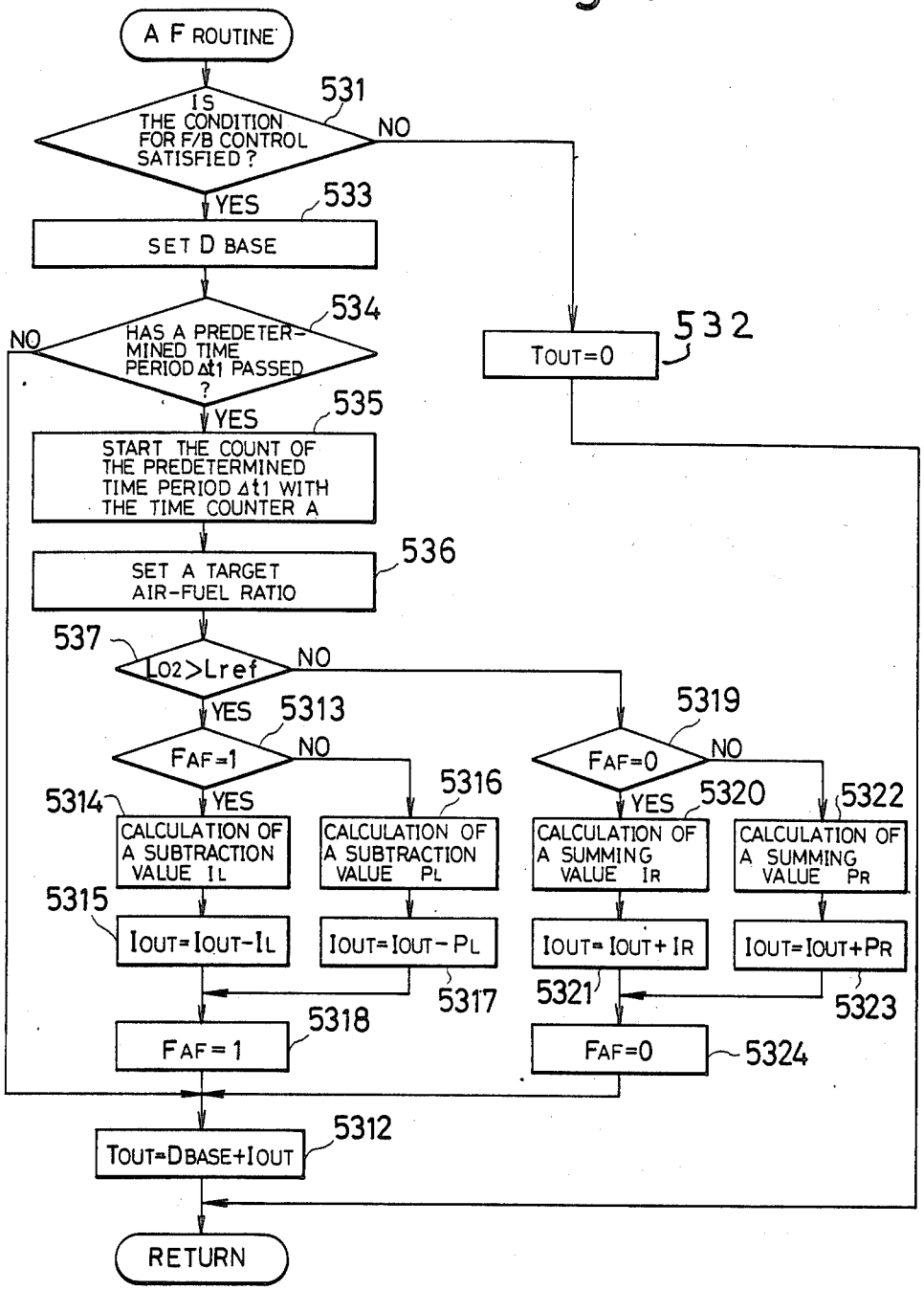
FIG. 8 is a flowchart showing steps of an A/F routine in a second embodiment according to the present invention.

Referring now to FIG. 8, the second embodiment of the present invention will be explained.

Since the construction of the system and the operation of the system other than the A/F routine are the same as the previous embodiment, the explanation thereof will not be repeated. Further, in the A/F routine shown in FIG. 8, the steps 531 through 537, and the step 5312 are the same as the previous embodiment.

At the step 537, whether or not the output signal level $LO_2$ of the $O_2$ sensor 14 is greater than the reference level Lref determined at the step 536 is detected from the information of the oxygen concentration. If $LO_2 > Lref$, it means that the air-fuel ratio of the mixture is leaner than the target air-fuel ratio, and whether or not an air-fuel ratio flag $F_{AF}$ which indicates a result of the detection by the step 537 at the previous cycle of calculation is equal to "1" is detected at a step 5313. If $F_{AF}=1$, it means that the air-fuel ratio was also lean in the previous cycle, and a subtraction value $I_L$ is calculated at a step 5314. As in the previous embodiment, the subtraction value $I_L$ is obtained by multiplication among the constant $K_1$, the engine speed $N_e$, and the absolute pressure $P_{BA}$, $(K_1 \cdot N_e \cdot P_{BA})$, and is dependent on the amount of the intake air of engine 5. After the calculation of the subtraction value $I_L$, a correction value $I_{OUT}$, which was previously calculated by the execution of operation of the A/F routine, is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 5315. On the other hand, if $F_{AF}=0$, it means that the air-fuel ratio of the previous cycle was rich and the air-fuel ratio has turned from the rich side to the lean side. Therefore, a subtraction value $P_L$ is calculated at a step 5316. The subtraction value $P_L$ is obtained by multiplication between a constant $K_3(K_3>1)$ and the subtraction value $I_L$, $(K_3 \cdot I_L)$. After the calculation of the subtraction value $P_L$, the correction value $I_{OUT}$, which was previously calculated by the execution of the A/F routine, is read out from a memory location $a_1$ in the RAM 31. Subsequently, the subtraction value $P_L$ is subtracted from the correction value $I_{OUT}$, and a result is in turn written in the memory location $a_1$ of the RAM 31 as a new correction value $I_{OUT}$, at a step 5317. After the calculation of the correction value $I_{OUT}$ at the step 5315 or 5317, a value "1" is set at the flag $F_{AF}$ for indicating that the air-fuel ratio is lean, at a step 5318. On the other hand, if $LO_2 \leqq Lref$ at the step 537, it means that the current air-fuel ratio of the mixture is richer than the target air-fuel ratio, and whether or not the air-fuel ratio flag $F_{AF}$ is equal to "0" is detected at a step 5319. If $F_{AF}=0$, it means that the air-fuel ratio was also rich in the previous cycle, and the summing value $I_R$ is calculated at a step 5320. As in the previous embodiment, the summing value $I_R$ is calculated by a multiplication among the constant value $K_2(\neq K_1)$, the engine speed $N_e$, and the absolute pressure $P_{BA}(K_2 \cdot N_e \cdot P_{BA})$, and is dependent on the amount of the intake air of engine 5. After the calculation of the summing value $I_R$, the correction value $I_{OUT}$, which was previously calculated by the execution of the A/F routine, is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5321. If $F_{AF}=1$ at the step 5319, it means that the air-fuel ratio was lean and the air-fuel ratio has turned from the lean side to the rich side, and a summing value $P_R$ is calculated at a step 5322. The summing value $P_R$ is obtained by multiplication between a constant $K_4(K_4>1,\ K_4<K_3)$ and the summing value $I_R$, $(K_4 \cdot I_R)$. After the calculation of the summing value $P_R$, the correction value $I_{OUT}$, which was previously calculated by the execution of operation of the A/F routine, is read out from a memory location $a_1$ in the RAM 31. Subsequently, the summing value $P_R$ is added to the correction value $I_{OUT}$, and a result is in turn written in the memory location $a_1$ of the RAM 31 as a new correction value $I_{OUT}$, at a step 5323. After the calculation of the correction value $I_{OUT}$ at the step 5321 or 5323, a value "0" is set for the flag $F_{AF}$ for indicating that the air-fuel ratio is rich, at a step 5324. After the calculation of the correction value $I_{OUT}$ at the step 5315, 5317, 5321 or 5323 in this way, the correction value $I_{OUT}$ and the period of base duty ratio $D_{BASE}$ set at the step 533 are added together, and the result is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed as in the case of the previous embodiment. In this case, the correction value $I_{OUT}$ calculated by the A/F routine up to the previous cycle is read out.

After the execution of the A/F routine in this way, the operation for controlling the open/close valve 9, i.e. the steps 54 through 57, is performed in the same manner as in the previous embodiment.

In the case of the second embodiment explained above, the supply of the air intake side secondary air is controlled through either one of an "integral term control" and a "proportional term control", in which the correction amount is determined in due consideration of the delay of response from the time of the supply of the air intake side secondary air to the time of the detection of the oxygen concentration in the exhaust gas. Thus, the hunting of the air-fuel ratio is prevented. Specifically, in the integral term control, the subtraction value $I_L$ is subtracted from the correction value $I_{OUT}$ or the summing value $I_R$ is added to the correction value $I_{OUT}$ depending on the output signal level of the $O_2$ sensor every predetermined time period $\Delta t_1$. In the proportional term control which is effected when the output signal level of the $O_2$ sensor has changed across the level corresponding to the target air-fuel ratio, the subtraction value $P_L$ larger than the subtraction value $I_L$ is subtracted from the correction value $I_{OUT}$ when it is determined, from the output signal level of the $O_2$ sensor, that the air-fuel ratio has changed from the rich side to the lean side with respect to the target air-fuel ratio. On the other hand, when it is determined from the output signal level of the $O_2$ sensor that the air-fuel ratio has changed from the lean side to the rich side with respect to the target air-fuel ratio, the summing value $P_R$ greater than the summing value $I_R$ is added to the correction value $I_{OUT}$.

Thus, in the second embodiment of the air intake side secondary air supply system, the base valve open period, of the open/close valve within one duty period which is set in response to the predetermined plurality of operation parameters is corrected by the summing operation or the subtraction operation depending on the output signal level of the $O_2$ sensor, to perform a PI (proportional integral) type duty ratio control of the supply of the air intake side secondary air. Further, since the correction value for enriching the air-fuel ratio is determined to be greater than the correction value for making the air-fuel ratio leaner, the response characteristic of the system is greatly improved. More precisely, the air-fuel ratio is very rapidly controlled toward the target air-fuel ratio on the lean side. Thus, the driveability of the vehicle is greatly improved.

Further, from the foregoing it will be appreciated that according to the present invention, the fuel consumption characteristic of the engine can be improved by setting the target value of the air-fuel ratio control on the leaner side of the stoichiometric air-fuel ratio. This is enabled by the employment of the $O_2$ sensor 14 having an output signal characteristic as shown in FIG. 2.

While the preferred form of the present invention has been described, it is to be understood that modifications will be apparent to those skilled in the art without departing from the spirit of the invention. For example, although the time period $\Delta t_1$ is set constant in the preferred embodiments, it is also possible to vary the time period $\Delta t_1$ depending on the operational state of the vehicle. For instance, the response characteristic of the system can be improved by determining the time period $\Delta t_1$ such that it becomes short when the engine speed or the amount of the intake air is high. Further, although the time counter B is incorporated in the CPU 29 in the preferred embodiments, it is also possible to provide a time counter outside the CPU 29, and to design the system to provide the valve open drive command signal to the drive circuit 28 when the count value of the counter has reached the value "0".

What is claimed is:

1. An air intake side secondary air supply system for an internal combustion engine having an air intake passage with a carburetor and an exhaust passage, comprising:

an air intake side secondary air supply passage communicating with the air intake passage on downstream side of the carburetor;

an open/close valve disposed in said air intake side secondary air supply passage;

an oxygen concentration sensor disposed in the exhaust passage; and duty control means for determining a base valve open period of said open/close valve in accordance with engine parameters every predetermined period, detecting whether an air-fuel ratio of mixture to be supplied to the engine is leaner or richer with respect to a target air-fuel ratio by means of an output signal level of the oxygen concentration sensor at least every said predetermined period, providing an output valve open period by subtracting a first predetermined correction amount from said base valve open period when a detected air-fuel ratio of mixture is leaner than the target air-fuel ratio, and adding a second predetermined amount to said base valve open period when the detected air-fuel ratio of mixture is richer than the target air-fuel ratio, wherein said duty control means increases said first predetermined correction amount only when the air-fuel ratio of mixture has changed from a rich side to a lean side with respect to the target air-fuel ratio, and increases said second predetermined correction amount only when the air-fuel ratio of the mixture has changed from the lean side to the rich side with respect to the target air-fuel ratio, and said first and second predetermined correction amounts are set so that said second predetermined correction amount is smaller than said first predetermined correction amount.

2. An air intake side secondary air supply system for an internal combustion engine having an air intake passage with a carburetor and an exhaust passage, comprising:

an air intake side secondary air supply passage communicating with the air intake passage on the downstream side of said carburetor;

an open/close valve disposed in said air intake side secondary air supply passage;

an oxygen concentration sensor disposed in the exhaust passage; and detection and control means for detecting whether an air-fuel ratio of mixture to be supplied to the engine is leaner or richer with respect to a target air-fuel ratio through a level of an output signal of the oxygen concentration sensor and for periodically actuating said open/close valve, said detection and control means decreasing a valve open period of said open/close valve within each cyclic period by a first predetermined amount when a detected air-fuel ratio of mixture is leaner than the target air-fuel ratio and increasing the valve open period by a second predetermined amount when the detected air-fuel ratio of mixture is richer than the target air-fuel ratio, said second predetermined amount being different from said first predetermined amount.

3. An air intake side secondary air supply system as set forth in claim 2, in which said second predetermined amount is determined to be smaller than said first predetermined amount.

4. An air intake side secondary air supply system as set forth in claim 2, wherein said cyclic period is a predetermined period.

5. An air intake side secondary air supply system as set forth in claim 2, wherein said oxygen concentration sensor is of a type producing an output signal whose level is generally proportional to the oxygen concentration in exhaust gas when the air-fuel ratio of the mixture to be supplied to the engine is leaner than a stoichiometric air-fuel ratio.

6. An air intake side secondary air supply system as set forth in claim 5, wherein said first and second predetermined amounts are set according to an amount of an intake air of the engine.

* * * * *